US006513732B1

(12) United States Patent
Sumida et al.

(10) Patent No.: US 6,513,732 B1
(45) Date of Patent: Feb. 4, 2003

(54) FUEL INJECTION VALVE

(75) Inventors: Mamoru Sumida, Tokyo (JP); Norihisa Fukutomi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/652,039

(22) Filed: Aug. 31, 2000

(51) Int. Cl.[7] ..... B05B 1/34
(52) U.S. Cl. ..... 239/463; 239/585.4
(58) Field of Search ..... 239/463, 464, 239/533.3, 533.9, 533.12, 585.4, 585.5

(56) References Cited

U.S. PATENT DOCUMENTS 4,721,253 A * 1/1988 Noguchi et al. ..... 239/464
5,108,037 A * 4/1992 Okamoto et al. ..... 239/473
5,871,157 A 2/1999 Fukutomi et al. ..... 239/463
5,979,801 A * 11/1999 Munezane et al. ..... 239/463
6,047,905 A * 4/2000 Honda et al. ..... 123/298
6,092,743 A * 7/2000 Shibata et al. ..... 239/533.12
6,145,761 A * 11/2000 Muller et al. ..... 239/463
6,170,762 B1 * 1/2001 Sumida et al. ..... 239/463

FOREIGN PATENT DOCUMENTS

JP 10-103194 4/1998 ..... F02M/61/18
WO WO 99/10649 * 3/1999

* cited by examiner

*Primary Examiner*—Lesley D. Morris
(74) *Attorney, Agent, or Firm*—Sughrue Mion, PLLC

(57) ABSTRACT

A fuel injection valve capable of eliminating pressure loss at the upstream portion of swing grooves while speeding heat radiation from a swing body is provided. Most of an outer circumferential part of the swing body 13 for applying swing to fuel is in a full circumference engagement with an inner circumferential surface of a valve body 9 and further, the upstream portion of the swing grooves 20 is constructed by a doughnut-shaped common passage 13*d*.

6 Claims, 7 Drawing Sheets

71

FUEL INJECTION VALVE

BACKGROUND OF THE INVENTION

This invention is suitable for a fuel injection valve, particularly a fuel injection valve for cylinder injection, and relates to a structure of the fuel injection valve for injecting fuel from a fuel injection hole be applying swirl energy to a fuel flow.

FIG. 8 is a sectional side view showing the entire configuration of a conventional fuel injection valve 71 for cylinder injection. The fuel injection valve 71 for cylinder injection comprises a housing body 72 and a valve unit 73 which is swaged in one end of this housing body 72 and is covered with a holder 105. A fuel supply pipe 74 is connected to the other end of the housing body 72 and high-pressure fuel is supplied from this fuel supply pipe 74 into the fuel injection valve 71 for cylinder injection through a fuel filter 127. Also, the top end of the fuel injection valve 71 for cylinder injection is inserted into an insertion hole 76 for injection valve of a cylinder head 75 of an internal combustion engine and is sealed and mounted by a wave washer 130.

The valve unit 73 comprises a stepped hollow cylindrical-shaped valve body 79 having a small diameter cylindrical part 77 and a large diameter cylindrical part 78, a valve seat 81 which is fixed in the top of a center hole within the valve body 79 and has a fuel injection hole 80, a needle valve 82 which is a valve element for opening or closing the fuel injection hole 80 by making or breaking contact with the valve seat 81 using a solenoid unit 120 (described later), and a swirl body 83 which guides the needle valve 82 in the axial direction and applies swirl movements to fuel flowing into the fuel injection hole 80 of the valve seat 81 inwardly in the diameter direction. The valve body 79 of the valve unit 73 forms a housing of the fuel injection valve 71 for cylinder injection in cooperation with the housing body 72.

The housing body 72 comprises a first housing 100 having a flange 100*a* for mounting the fuel injection valve 71 for cylinder injection in the cylinder head 75, and has the solenoid unit 120 within the first housing 100. The solenoid unit 120 comprises a bobbin 122 wound by a coil 121 and a core 123 installed in an inner circumferential portion of this bobbin 122, and a winding of the coil 121 is connected to a connection terminal 126. The core 123 is formed in a hollow cylindrical shape so that the inside of the core 123 is used as a fuel passage, and a spring 125 is suspended between a sleeve 124 and the needle valve 82 in the hollow portion of the core 123.

A moving armature 101 is mounted in the other portion of the needle valve 82 in opposition to the top side of the core 123, and also the intermediate portion of the needle valve 82 is provided with a guide 82*a* for sliding and guiding the needle valve 82 along an inner circumferential surface of the valve body 79 and a needle flange 82*b* in engagement with a spacer 102 installed in the first housing 100.

FIG. 9 is an enlarged sectional side view showing the vicinity of the valve seat of the valve unit 73 and FIG. 10 is a front view seen from the side of the valve seat 81 of the swirl body 83. In the drawings, the swirl body 83 of the valve unit 73 is a member with a substantially hollow cylindrical shape having a center hole 85 for surrounding the needle valve 82 (valve element) in the center and slidably supporting it in the axial direction, and comprises a first end surface 86 in engagement with the valve seat 81, a second end surface 87 opposite to the valve seat 81, and a circumferential surface 89 having a portion in engagement with an inner circumferential surface 88 of the valve body 79 being a part of a hollow housing between these end surfaces when the swirl body 83 is assembled in the valve unit 73.

The second end surface 87 of the swirl body 83 is supported in engagement with a shoulder part 90 of the inner circumferential surface 88 of the valvehody 79 in the periphery, and also it is configured so that a passage groove 91 extending in the diameter direction is formed and fuel can flow from the inner circumferential portion to the outer circumferential portion of the second end surface 87.

The circumferential surface 89 of the swirl body 83 is provided with a plurality of outer circumferential surface parts 89*a* for defining a position to the valve body 79 in engagement with the inner circumferential surface 88 of the valve body 79 and a flow passage part 89*b* which is disposed between these outer circumferential surface parts 89*a* and forms an axial flow passage 92 of fuel along with the inner circumferential surface 88.

The axial end surface facing the valve seat 81 of the swirl body 83, namely the first end surface 86 is provided with an inner circumferential ring groove 94 with a predetermined width formed on an inner circumferential side adjacent to the center hole 85 of the first end surface 86, and a swirl groove 95 which is connected to the flow passage part 89*b* of the circumferential surface 89 at one end and extends inwardly in the approximately diameter direction therefrom and is connected to the inner circumferential ring groove 94 in the tangential direction at the other end.

Next, an operation of the fuel injection valve for cylinder injection will be described. Referring first to FIG. 8, when energizing the coil 121 of the solenoid unit 120 through connection terminal 126 from the outside, a magnetic flux is generated in a magnetic passage formed by the moving armature 101, the core 123 and the housing body 72, and the moving armature 101 is attracted to the side of the core 123 against an elastic force of the spring 125. Then, the needle valve 82 integral with the moving armature 101 moves to the right side (shown in FIG. 8) of a predetermined stroke until the needle flange 82*b* is brought into engagement with the spacer 102. Incidentally, the needle valve 82 is guided and held in the inner circumferential surface of the valve body 79 by the guide 82*a*.

Then, in FIGS. 9 and 10, when the top end of the needle valve 82 moves away from the valve sear 81 to form a gap, high—pressure fuel of introduced from the fuel supply pipe 74 first flows into the axial flow passage 92 of the circumferential surface from a passage between the valve body 79 and the needle valve 82 through the passage groove 91 of the second end surface 87 of the swirl body 83. Next, the high-pressure fuel flows into the swirl groove 95 of the first end surface 86 of the swirl body 83 inwardly in the diameter direction and flows into the inner circumferential ring groove 94 of the first end surface 86 in the tangential direction and forms swirl flow in a swirl chamber W constituted by the inner circumferential ring groove 94. Subsequently, the fuel flows into the injection hole 80 of the valve seat 81 and is sprayed from an outlet of the top of the injection hole 80.

Since the conventional fuel injection valve is configured as described above, a non-contact portion remains between the outer circumferential surface of the swirl body and the inner circumferential surface of the valve element, with the result that there was a problem that another radiator is required in case where combustion heat is large and temperature in the top of the fuel injection valve tends to become high. Also, in case of a specification of the swirl groove with a large sectional area, there was a problem that the axial flow passage relatively becomes narrow, so that pressure loss occurs in the axial flow passage and a desired flow velocity cannot be obtained in the swirl groove.

SUMMARY OF THE INVENTION

The invention is implemented to solve such problems, and it is an object of the invention to provide a fuel injection valve capable of achieving weight reduction of a swirl body while speeding heat radiation from the swirl body.

A fuel injection valve according to first aspect of the invention comprises a hollow-shaped valve body, a valve seat which is provided in the one end of this valve body and has a fuel injection hole, a valve element which moves within the valve body and makes or breaks contact with the valve seat to open or close the fuel injection hole, and a swirl body which is arranged around the valve element and slidably supports the valve element and also applies swirl to fuel flowing from the fuel injection hole, and further most of an outer circumferential part of the swirl body is in a full circumference engagement with an inner circumferential surface of the valve body.

In the fuel injection valve according to second aspect of the invention, the upstream portion of swing grooves provided in the swing body is formed in a common passage.

In the fuel injection valve according to third aspect of the invention, the common passage is constructed by a doughnut-shaped common passage.

In the fuel injection valve according to forth aspect of the invention, ribs are respectively formed between an inner surface of the outer circumferential part of the swirl body and a bottom part of the doughnut-shaped common passage and between an outer surface of a support part of the valve element and the bottom part of the doughnut-shaped common passage.

In the fuel injection valve according to fifth aspect of the invention, one end surface of the swirl body is in engagement with the valve seat while the other end surface is in engagement with a shoulder part of the valve body.

In the fuel injection valve according to sixth aspect of the invention, the swirl grooves provided in the swirl body are eccentric to a valve stem a: a constant distance and the side distant from this valve stem of the swirl grooves is connected to an outer circumference of a ring groove in the tangential direction.

In the fuel injection valve according to seventh aspect of the invention, a clearance fit is made so that a diametral clearance between an outer circumferential surface portion of the swirl body and an inner circumferential surface portion of the valve body is 7 $\mu$m or less.

In the fuel injection valve according to eighth aspect of the invention, the outer circumferential surface portion of the swirl body and the inner circumferential surface portion of the valve body are assembled by a press fit.

DETAILED DESCRIPTION OF THE PREFERRED EMBODIMENTS (First Embodiment)

Figure 1:
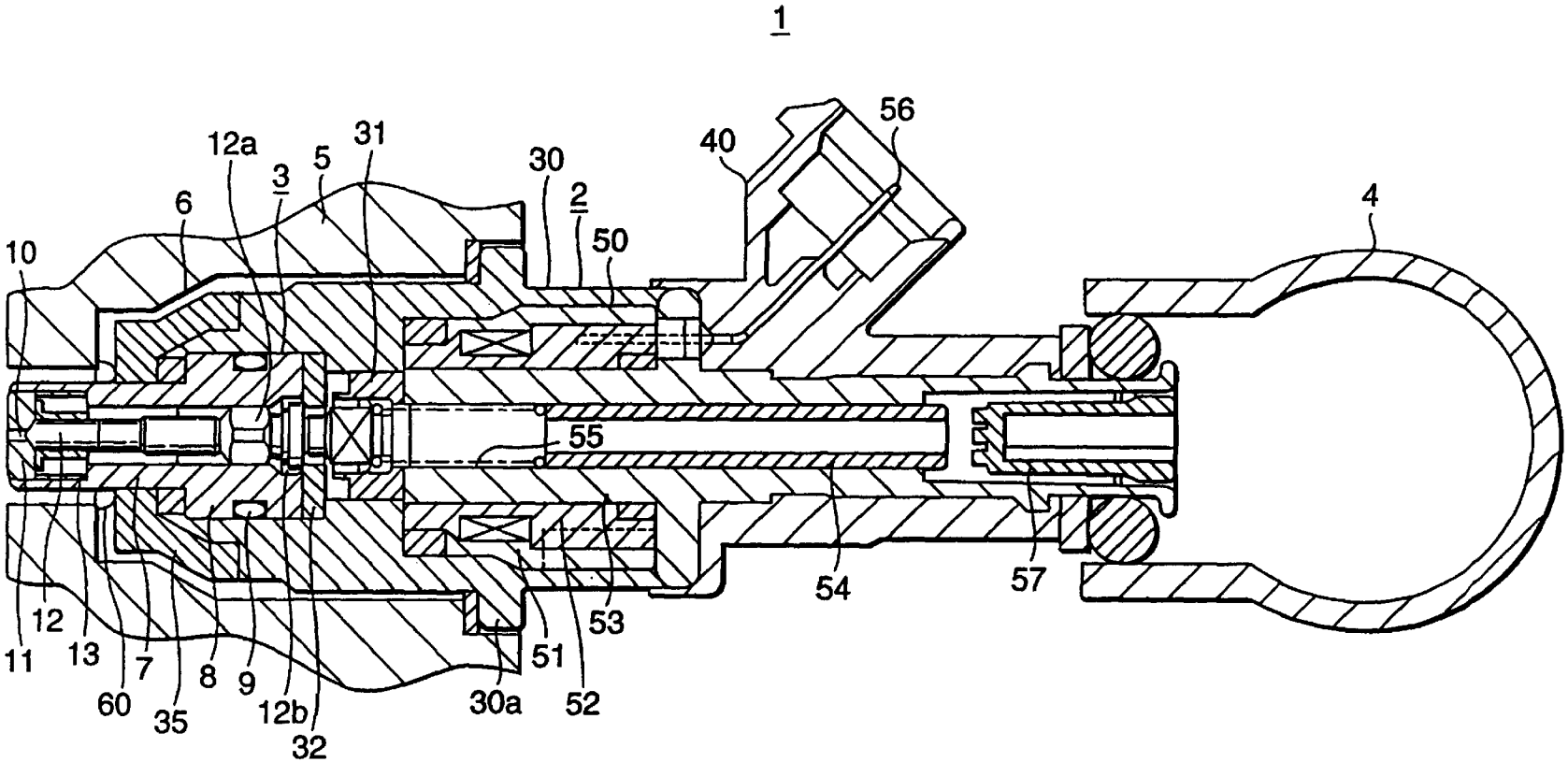
FIG. 1 is a sectional side view showing the entire configuration of a fuel injection valve according to a first embodiment of this invention.

FIG. 1 is a sectional side view showing the entire configuration of a fuel injection valve 1 for cylinder injection according to one embodiment of this invention. The fuel injection valve 1 for cylinder injection comprises a housing body 2 and a valve unit 3 which is swaged in one end of this housing body 2 and is covered with a holder 35. A fuel supply pipe 4 is connected to the other end of the housing body 2 and high-pressure fuel is supplied from this fuel supply pipe 4 into the fuel injection valve 1 for cylinder injection through a fuel filter 57. Also, the top end of the fuel injection valve 1 for cylinder injection is inserted into an insertion hole 6 for injection valve of a cylinder head 5 of an internal combustion engine and is sealed and mounted by a wave washer 60.

The valve unit 3 comprises a stepped hollow cylindrical-shaped valve body 9 having a small diameter cylindrical part 7 and a large diameter cylindrical part 8, a valve seat 11 which is fixed in the top of a center hole within the valve body 9 and has a fuel injection hole 10, a needle valve 12 which is a valve element for opening or closing the the fuel injection hole 10 by making or breaking contact with the valve seat 11 using a solenoid unit 50. (described later), and a swirl body 13 which guides the needle valve 12 in the axial direction and applies swirl movements to fuel flowing into the fuel injection hole 10 of the valve seat 11 inwardly in the diameter direction. The valve body 9 of the valve unit 3 forms a housing of the fuel injection valve 1 for cylinder injection in cooperation with the housing body 2.

The housing body 2 comprises a first housing 30 having a flange 30*a* for mounting the fuel injection valve 1 for cylinder injection in the cylinder head 5, and has the solenoid unit 50 within the first housing 30. The solenoid unit 50 comprises a bobbin 52 wound by a coil 51 and a core 53 installed in an inner circumferential portion of this bobbin 52, and a winding of the coil 51 is connected to a connection terminal 56. The core 53 is formed in a hollow cylindrical shape so that the inside of the core 53 is used as a fuel passage, and a spring 55 is suspended between a sleeve 54 and the needle valve 12 in the hollow portion of the core 53.

A moving armature 31 is mounted in the other portion of the needle valve 12 in opposition to the top side of the core 53, and also the intermediate portion of the needle valve 12 is provided with a guide 12*a* for sliding and guiding the needle valve 12 along an inner circumferential surface of the valve body 9 and a needle flange 12*b* in engagement with a spacer 32 installed in the first housing 30.

Figure 2A:
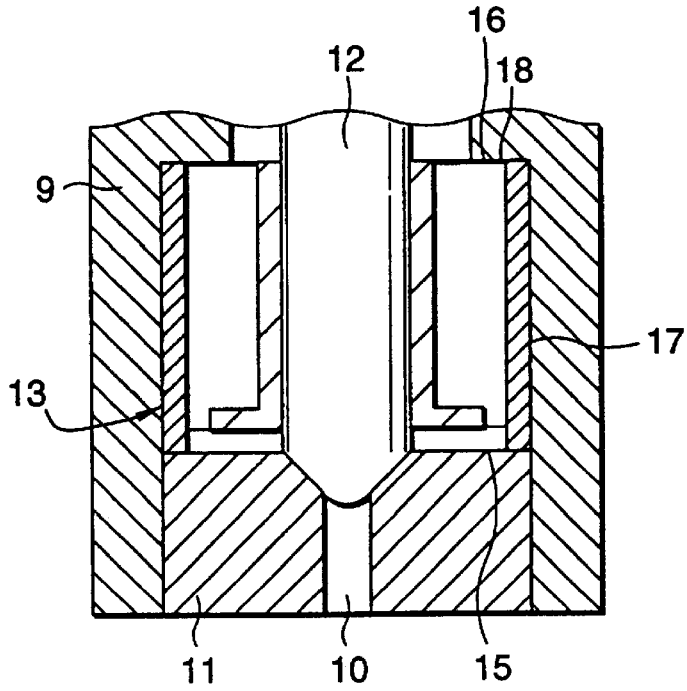
FIG. 2A is an enlarged sectional side view showing the vicinity of a valve seat of a valve unit of FIG. 1.
Figure 3:
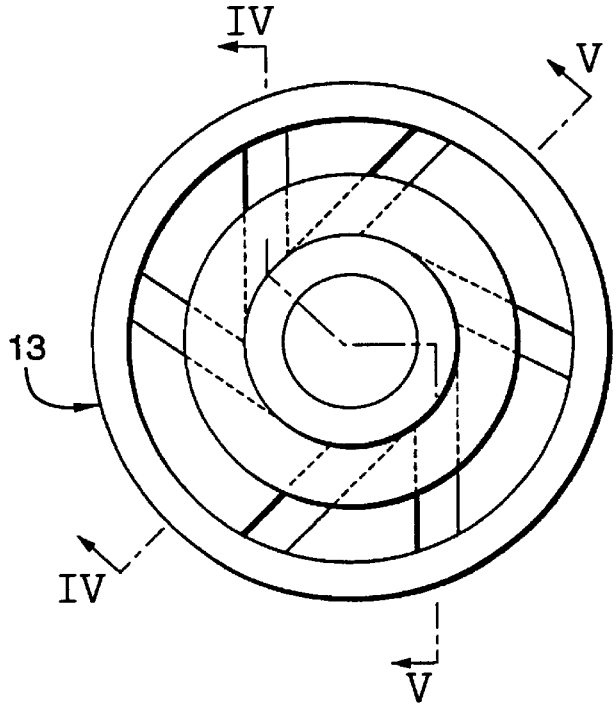
FIG. 3 is a plan view showing a swirl body of FIG. 1.
Figure 4:
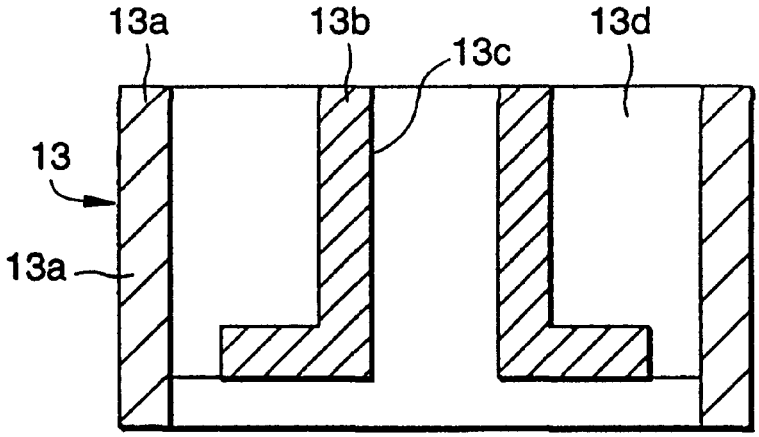
FIG. 4 is a sectional view taken on line IV—IV of FIG. 3.
Figure 5:
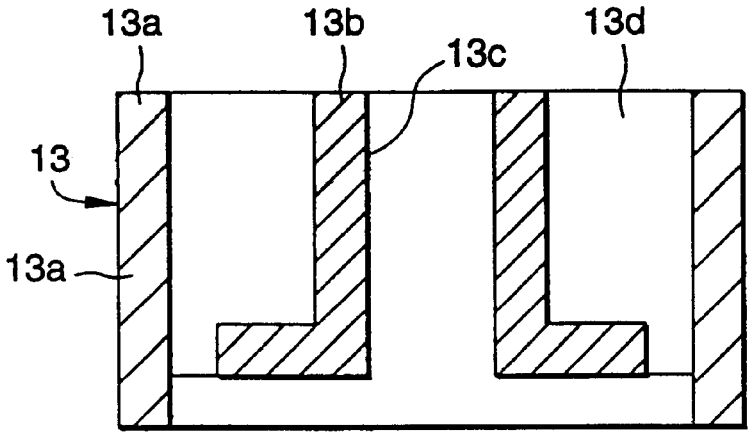
FIG. 5 is a sectional view taken on line V—V of FIG. 3.
Figure 6:
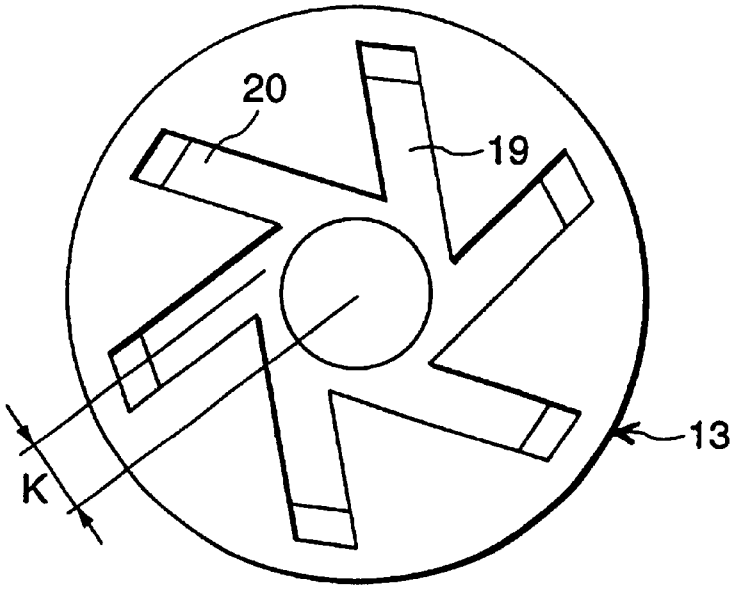
FIG. 6 is a bottom view showing the swirl body of FIG. 1.

FIG. 2A is an enlarged sectional side view showing the vicinity of the valve seat 11 of the valve unit 3, and FIG. 3 is a plan view showing a portion of the swirl body 13 according to the embodiment, and FIG. 4 is a sectional view taken on line IV—IV of FIG. 3, and FIG. 5 is a sectional view taken on line V—V, and FIG. 6 is a bottom view of the swirl body 13.

In the drawings, numeral 13*a* is an outer circumferential part of the swirl body, and numeral 13*b* is a support part of the valve element, and numeral 13*c* is a slide part of the valve element, and numeral 13*d* is a doughnut-shaped common passage, and numeral 13*e* is a bottom part of the doughnut-shaped common passage, and numeral 15 is a first end surface to the valve seat 11, and numeral 16 is a second end surface opposite to the valve seat and the second end surface 16 of the swirl body 13 is supported in engagement with a shoulder part 18 of an inner circumferential surface 17 of the valve body 9 in the periphery. Also, as shown in FIG. 6, the swirl body 13 comprises a ring groove 19 provided on an Inner circumferential side of the axial end surface facing the valve seat 11, and a plurality of swirl grooves 20 which is connected to the upstream side at one end and is connected to a position offset (K) from the center relative to the ring groove 19 at the other end.

As shown in the drawings, the outer circumferential part 13*a* of the swirl body is in a full circumference engagement with the inner circumferential surface of the valve body 9, so that heat radiation from this engagement surface can be more improved. Also, by providing the doughnut-shaped common passage 13*d,* pressure loss at the upstream portion of the swirl grooves 20 can be eliminated, and even in case of a specification of the swirl grooves 20 with a large sectional area, characteristics of the swirl body 13 can be exerted without any problems. Further, by providing the doughnut-shaped common passage 13*d,* a large area of contact between the swing body 13 and the fuel is formed, with the result that weight reduction of the whole apparatus can be achieved by the doughnut-shaped common passage 13*d* while heat radiation from the swing body 13 can be sped by a flow of the fuel.

Figure 7:
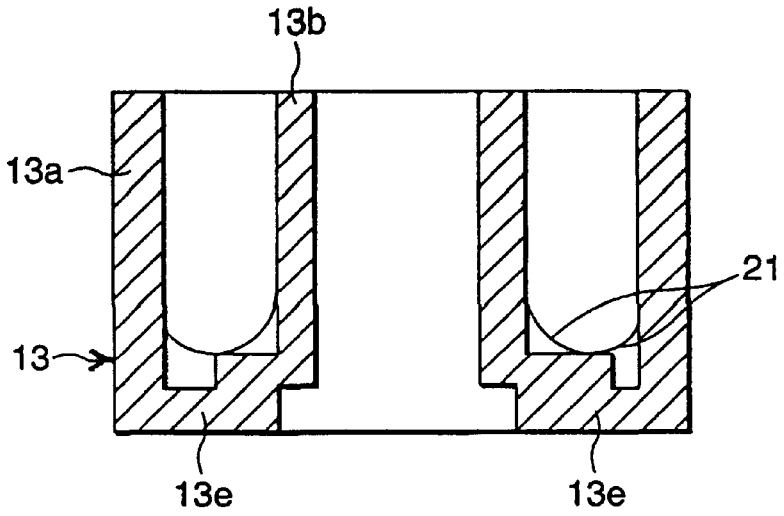
FIG. 7 is a sectional side view of the swirl body of FIG. 1.
Figure 8:
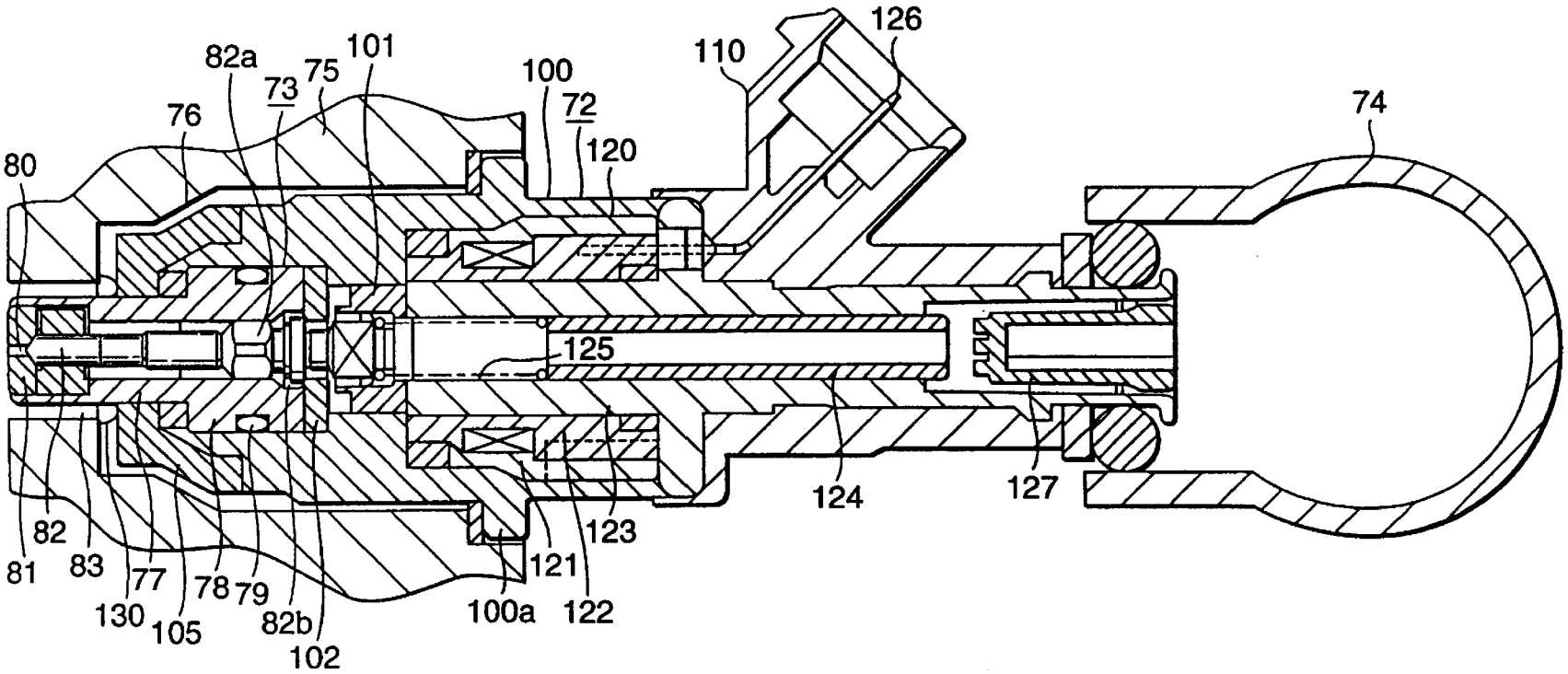
FIG. 8 PRIOR ART
FIG. 8 is a sectional side view showing the entire configuration of a conventional fuel injection valve.
Figure 9:
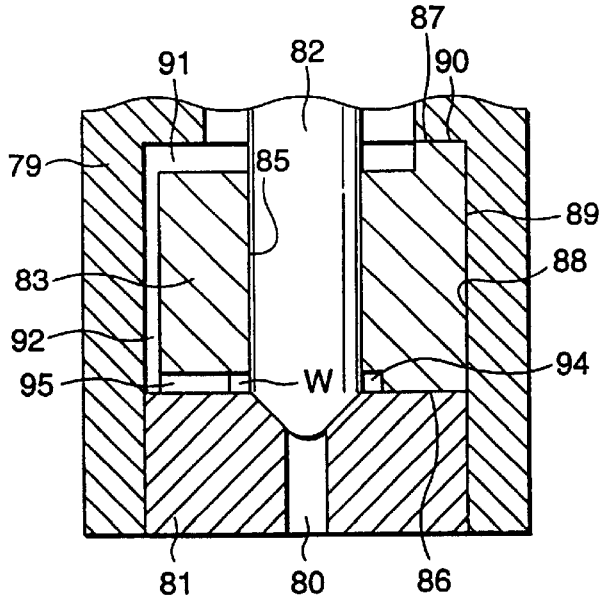
FIG. 9 PRIOR ART
FIG. 9 is an enlarged sectional side view showing the vicinity of a valve seat of a valve unit of FIG. 8.
Figure 10:
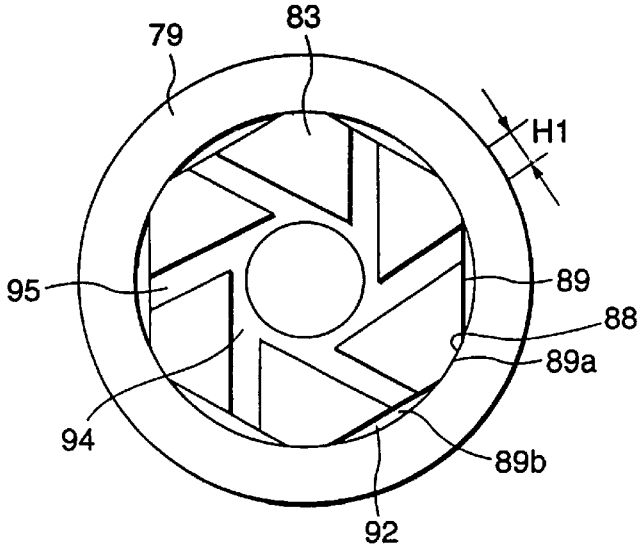
FIG. 10 PRIOR ART
FIG. 10 is a plan view seen from the side of the valve seat of a swirl body of FIG. 8.

Also, as shown in FIG. 7, by forming ribs 21 between the inner surface of the outer circumferential part 13*a* of the swirl body and the bottom part 13*e* of the doughnut-shaped common passage and between the outer surface of the support part 13*b* of the valve element and the bottom part 13*e* of the doughnut-shaped common passage so as to straddle them respectively, the strength can be increased. As a processing method of the swirl body 13, the swirl body 13 can be easily formed by adopting metal injection molding. Further, when the valve body 9 is integrally formed with the valve seat 11, it can be configured so as to be incorporated from the upstream side of the swirl body 13 and the valve body 9. Also, similar effect occurs even in the case that a top shape of the valve element 12 is formed in various shapes such as a ball valve. In this case, the slide part 13*c* of the valve element of the swirl body 13 may be formed from a plurality of regions with different diameters.

(Second Embodiment)

In the first embodiment shown in FIG. 2A, by amking a clearance fit so that a diametral clearance between the outer circumferential portion of the swirl body 13 and the inner circumferential surface 17 of the valve body 9 is 7 $\mu$m or less, working and assembly can be facilitated and characteristics of heat radiation can be improved. Also, the outer circumferential portion of the swirl body 13 and the inner circumferential surface 17 of the valve body 9 may be assembled by a press fit, and this case has the effect of sufficiently ensuring the characteristics of heat radiation.

According to a fuel injection valve of first aspect of the invention, the fuel injection valve comprises a hollow-shaped valve body, a valve seat which is provided in the one end of this valve body and has a fuel injection hole, a valve element which moves within the valve body and makes or breaks contact with the valve seat to open or close the fuel injection hole, and a swing body which is arranged around the valve element and slidably supports the valve element and also applies swirl to fuel flowing from the fuel injection hole, and further most of an outer circumferential part of the swirl body is in a full circumference engagement with an inner circumferential surface of the valve body, so that an effect of heat radiation can be improved.

According to the fuel injection valve of second aspect of the invention, the upstream portion of swirl grooves provided in the swirl body is formed in a common passage, so that pressure loss at the upstream portion of the swing grooves can be eliminated.

According to the fuel injection valve of third aspect of the invention, the common passage is constructed by a doughnut-shaped common passage, so that a large area of contact between the swirl body and the fuel at this portion is formed, with the result that weight reduction of the whole apparatus can be achieved while heat radiation from the swirl body can be sped by a flow of the fuel.

According to the fuel injection valve of fourth aspect of the invention, ribs are respectively fonned between an inner surface of the outer circumferential tart of the swirl body and a bottom part of the doughnut-shaped common passage and between an outer surface of a support part of the valve element and the bottom part of the doughnut-shaped common passage, so that the strength can be increased.

According to the fuel injection valve of fifth aspect of the invention, one end surface of the swirl body is in engagement with the valve seat while the other end surface is in engagement with a shoulder part of the valve body, so that the contact area can be increased with reference to nor only heat transfer of an outer circumferential surface part of the swirl body but also heat transfer from both the end surface of the swirl body, with the result that characteristics of heat radiation can be improved.

According to the fuel injection valve of sixth aspect of the invention, the swirl grooves provided in the swirl body are eccentric to a valve stem at a constant distance and the side distant from this valve stem of the swirl grooves is connected to an outer circumference of a ring groove in the tangential direction, so that fuel smoothly flows into the tangential direction of the ring groove from swirl grooves at a high speed and a collision of a plurality of injection flows is eliminated.

Figure 2B:
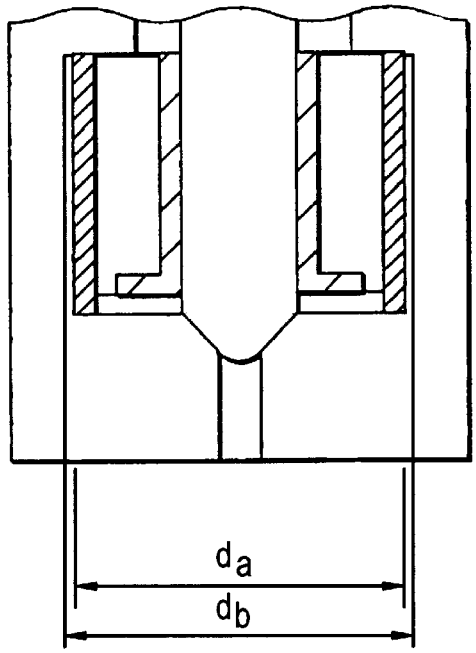
FIGS. 2B and 2C are enlarged sectional side views showing the vicinity of a valve seat of a valve unit according to modified embodiments of this invention.

According to the fuel injection valve of seventh aspect of the invention as shown in FIG. 2B, a clearance fit is made so that a diametral clearance between an outer circumferential surface portion of the swirl body and an inner circumferential surface portion of the valve body is 7 $\mu$m or less, so that working and assembly can be facilitated and characteristics of heat radiation can be improved.

Figure 2C:
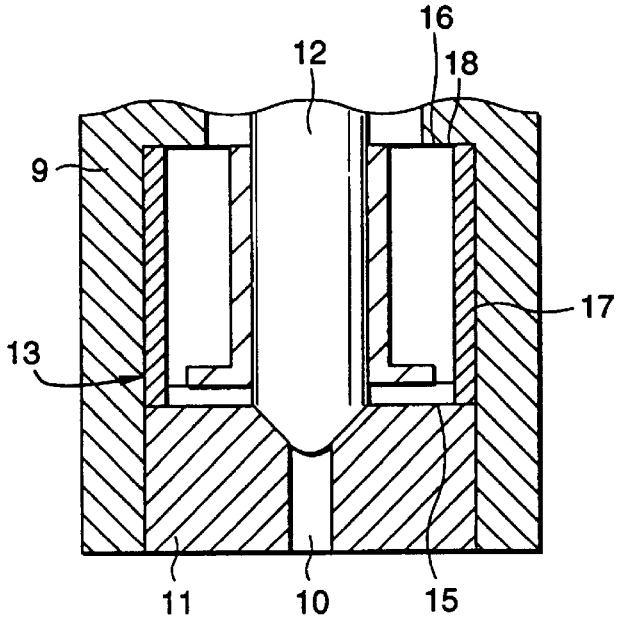

According to the fuel injection valve of eighth aspect of the invention as shown in FIG. 2C, the outer circumferential surface portion of the swirl body and the inner circumferential surface portion of the valve body are assembled by a press fit (an inner diameter db of the valve body is smaller than an outer diameter of the swirl body), so that the characteristics of heat radiation can be sufficiently ensured.

What is claimed is:

1. A fuel injection valve, comprising:

a hollow-shaped valve body having a shoulder part on an inner circumferential surface thereof to provide an enlarged space therein, a valve seat which is provided in one end of said valve body and has a fuel injection hole, a valve element which moves within said valve body and makes or breaks contact with said valve seat to open or close the fuel injection hole, and a swirl body arranged around said valve element and extending from the valve seat at one end surface thereof to the shoulder part of the valve body at another end surface thereof, said swirl body slidably supporting said valve element and also applying swirl to fuel flowing from the fuel injection hole, wherein most of an outer circumferential part of said swirl body is in full circumferential engagement with an inner circumferential surface of said valve body, said swirl body is provided with a plurality of swirl grooves at an upstream portion thereof to form a common passage, and the common passage is constructed by a doughnut-shaped common passage.

2. The fuel injection valve as defined in claim 1, wherein ribs are respectively formed between an inner surface of the outer circumferential part of said swirl body and a bottom part of the doughnut-shaped common passage, and between an outer surface of a support part of said valve element and the bottom part of the doughnut-shaped common passage.

3. The fuel injection valve as in claim 1, wherein swirl grooves provided in the swirl body are eccentric to a longitudinal central axis of said swirl body at a constant distance, and a distal end of the swirl grooves distanced from the longitudinal central axis of said swirl body is connected to an outer circumference of a ring groove in a tangential direction.

4. The fuel injection valve as in claim 1, wherein a clearance fit is made so that a diametral clearance between an outer circumferential surface portion of said swirl body and an inner circumferential surface portion of said valve body is 7 $\mu$m or less.

5. The fuel injection valve as in claim 1, wherein the outer circumferential part of said swirl body and the inner circumferential surface of said valve body are assembled by a press fit.

6. A fuel injection valve, comprising:

a hollow-shaped valve body;

a valve seat provided at one end of said valve body and having a fuel injection hole;

a valve element that is movable within said valve body and makes or breaks contact with said valve seat to open or close the fuel injection hole; and a swirl body arranged around said valve element, said swirl body having an outer circumferential part and a support part coaxially disposed within the outer circumferential part to form a doughnut-shaped common passage therebetween, said support part slidably supporting said valve element, said swirl body having a plurality of swirl grooves extending radially from a proximal end eccentric to a longitudinal axis of said valve body to cause a fuel flow from the fuel injection hole to flow in a swirl direction, wherein most of an outer circumferential part of said swirl body is in full circumferential engagement with an inner circumferential surface of said valve body.

* * * * *